US006095936A

United States Patent [19]

Kirkpatrick et al.

[11] Patent Number: 6,095,936

[45] Date of Patent: Aug. 1, 2000

[54] SHOOTING AID FOR BASKETBALL PLAYERS

[76] Inventors: Andrew M Kirkpatrick, 2101 Ridley Creek Rd., Media, Pa. 19063; Robert C. Kirkpatrick, 33 Taylor's Farm Dr., Newark, Del. 19711; Theodore J. Kirkpatrick, 23 Henki Rd., Wynnewood, Pa. 19096

[21] Appl. No.: 08/907,600

[22] Filed: Aug. 8, 1997

[51] Int. Cl.[7] ..... A63B 69/00

[52] U.S. Cl. ..... 473/450; 434/248; 473/447

[58] Field of Search ..... 434/248, 258; 473/447, 450, FOR 101, 422

[56] References Cited

U.S. PATENT DOCUMENTS

| | | | |
|---|---|---|---|
| 3,820,783 | 6/1974 | Caveness . | |
| 4,383,685 | 5/1983 | Bishop | 473/450 |
| 4,579,341 | 4/1986 | Furr . | |
| 4,919,425 | 4/1990 | Wolf . | |
| 5,135,217 | 8/1992 | Swain . | |
| 5,188,365 | 2/1993 | Picard . | |
| 5,228,682 | 7/1993 | Wolf . | |
| 5,271,617 | 12/1993 | Gilford . | |
| 5,320,342 | 6/1994 | Houck | 473/450 |
| 5,348,292 | 9/1994 | Norman | 473/450 X |
| 5,704,856 | 1/1998 | Morse | 473/422 |

FOREIGN PATENT DOCUMENTS

| | | | |
|---|---|---|---|
| 1663 | 6/1981 | WIPO | 473/101 |

*Primary Examiner*—John A. Ricci

*Attorney, Agent, or Firm*—Connolly Bove Lodge & Hutz LLP

[57] ABSTRACT

A shooting aid for basketball players designed to keep the elbow of the shooting arm in towards the center line of the body during shooting. The shooting aid comprises a sleeve adapted to fit around the shooting arm of the basketball player; a clip adapted to be secured to clothing worn by the basketball player; and an elastic cord with two ends having one end attached to the sleeve and the other end attached to the clip, wherein the cord is of sufficient length to restrain the position of the player's shooting arm when the player shoots a basketball. In another embodiment, a belt adapted to be worn by the player can be used instead of the clip.

9 Claims, 3 Drawing Sheets

10
12
14
16
17
18
20
22
24
26
28
30
32
34
38
3-3

Fig. 8.
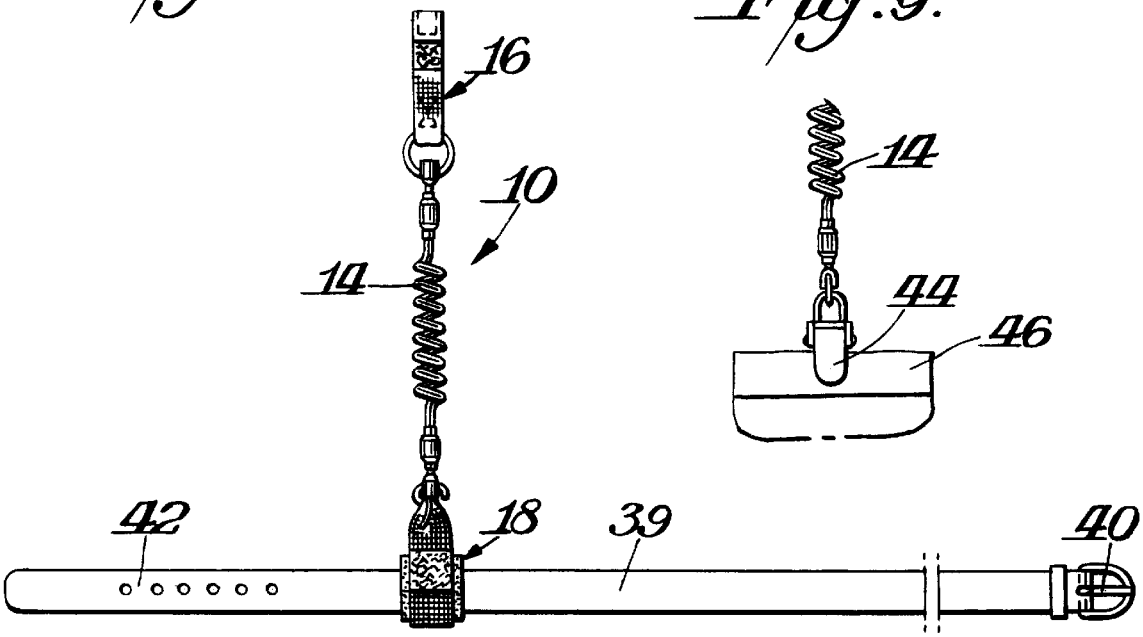
Fig. 9.
Fig. 7.
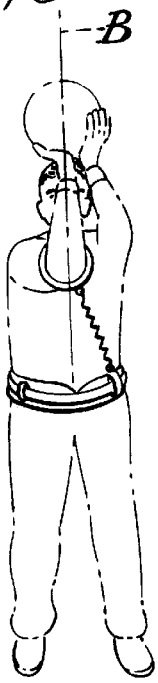

SHOOTING AID FOR BASKETBALL PLAYERS

FIELD OF THE INVENTION

This invention relates to a shooting aid for basketball players and more particularly to a device worn by a basketball player to aid the player in developing a consistent basketball shot. The training aid is designed to position the player's shooting elbow in towards the center line of the body during the shooting motion.

BACKGROUND OF THE INVENTION

Basketball is one of the most popular sports in the world. Points are generally scored by shooting the basketball through a hoop generally mounted about ten feet above the playing surface. Good shooting technique enhances a player's ability to score points.

Numerous methods for shooting the basketball have been developed. For example, there are shots known as the lay-up, the hook shot, the two-handed set shot, the dunk, and the jumpshot. Of all of these shots, none has developed as much importance in the modern game of basketball as the jump shot.

In a properly executed jump shot, the player jumps into the air and shoots the ball at the apex of the player's jump. Because of the increased speed and size of basketball players, the jump shot is an extremely effective method for scoring points. This is particularly true when the jump shot is combined with other techniques for getting unobstructed shots at the basket. These techniques include shooting a jump shot after executing a head or body fake. In addition, a jump shot can be used after a player comes off a screen set by another player.

Because of the versatility of the jump shot, proper execution of this shot is critical to achieving efficiency in scoring points. In the preferred method for executing a jump shot, the elbow of the shooting arm is kept in towards the centerline of the body during the shooting motion. The centerline of the body is an imaginary line dividing the player vertically down the middle of his or her body. When the elbow of the shooting arm is not along this line when shooting, the basketball has a tendency to stray from its proper shooting trajectory. This tendency causes a decrease in the percentage of shots that fall through the hoop.

A number of shooting aids have been developed to assist players with their shooting techniques. U.S. Pat. No. 4,383,685 to Bishop discloses a training device in which the player wears a vest to which is pivotally mounted a "guide bar". The guide bar guides the basketball player's arm in a generally vertical plane. This device is awkward, requiring the player to wear a vest with a bulky attachment. The Bishop device also relates to an old-style "push-shot" technique where the arm is positioned away from the body centerline. This technique has been replaced by the jump shot.

U.S. Pat. No. 4,579,341 to Furr discloses another basketball shooting aid. The player wears a body harness from which extends a metal L-shaped guide member to constrain the shooting arm. The projecting metal guide member flares out from the device and remains in this position after the player takes a shot. This device is bulky and awkward. It also has the further disadvantage that it must be disassembled and reassembled for right and left handed players.

U.S. Pat. No. 3,820,783 to Caveness shows a belt-supported bracket that has an extendable arm attached to it.

The arm has a transverse gage bar attached to its upper end to indicate the height at which a user's elbow should be raised during shooting. A guide bar depending from the gage bar indicates the lateral position of the elbow during shooting. This device is unwieldy because of its bulk.

A number of other devices have been developed to remove or lessen interference from a basketball player's guide arm and hand during shooting. U.S. Pat. Nos. 4,919,425 and 5,228,682 to Wolf and U.S. Pat. No. 5,320,342 to Houck are examples of these devices. These patents are directed to problems very different than that solved by the present invention.

Additional devices have been developed to promote the correct motion of the shooting hand during execution of a shot. U.S. Pat. No. 5,135,217 to Swain and U.S. Pat. No. 5,271,617 to Gilford are two such devices. However, these patents are directed to problems very different than that solved by the present invention.

SUMMARY OF THE INVENTION

Accordingly, it is an object of the present invention to provide a training aid for basketball players which is worn by the player and which serves to train the player to keep his elbow in towards the center of his body during the shooting motion, which is the proper alignment when executing a basketball shot.

It is a further object of the invention to provide a training aid for use by basketball players which is adapted to be worn by the player and which is lightweight.

It is a further object of the invention to provide a training aid for use by basketball players which is worn by the player and which is adapted for use by either a right-handed or a left-handed player.

It has been surprisingly found that these objects are achieved by a shooting aid for a basketball player, comprising the combination of a sleeve adapted to fit around the shooting arm of the basketball player; a clip adapted to be secured to clothing worn by the basketball player; and an elastic or resilient cord with two ends having one end attached to the sleeve and the other end attached to the clip, wherein the cord is of sufficient length and provides sufficient tension to restrain the position of the player's shooting arm when the player shoots a basketball. The sleeve is preferably worn proximate to the elbow of the player's shooting arm. The cord has sufficient length and sufficient tension to resist movement of the player's elbow away from the centerline of the body when the player shoots a basketball. If a belt is used in place of the clip, the player wears the belt and one end of the elastic cord attached to the belt by a suitable attaching means.

The use of this device does not unnecessarily interfere with other aspects of the basketball player's game such as dribbling the basketball, catching the basketball, or passing the basketball. Furthermore, the player retains the ability to use either hand to break any fall that may occur during a basketball game. As a result, the shooting aid can be worn under actual game conditions which represents a distinct advantage over the prior art devices.

Further objects and advantages of the invention will become apparent from the following description taken in conjunction with the accompanying drawings. This description and drawings are representative and are not intended to limit the invention.

BRIEF DESCRIPTION OF THE DRAWINGS

FIG. 7 is a front view of a player shooting a basketball while wearing the shooting aid with the shooting elbow in the correct shooting position;

FIG. 8 is a side view of an alternative embodiment of the shooting aid; and

FIG. 9 is a fragmental elevational view of another alternative embodiment of the shooting aid in which the cord is attached to a clip that clips on the player's clothing.

DESCRIPTION OF THE PREFERRED EMBODIMENTS

Figures 1, 2, 3:
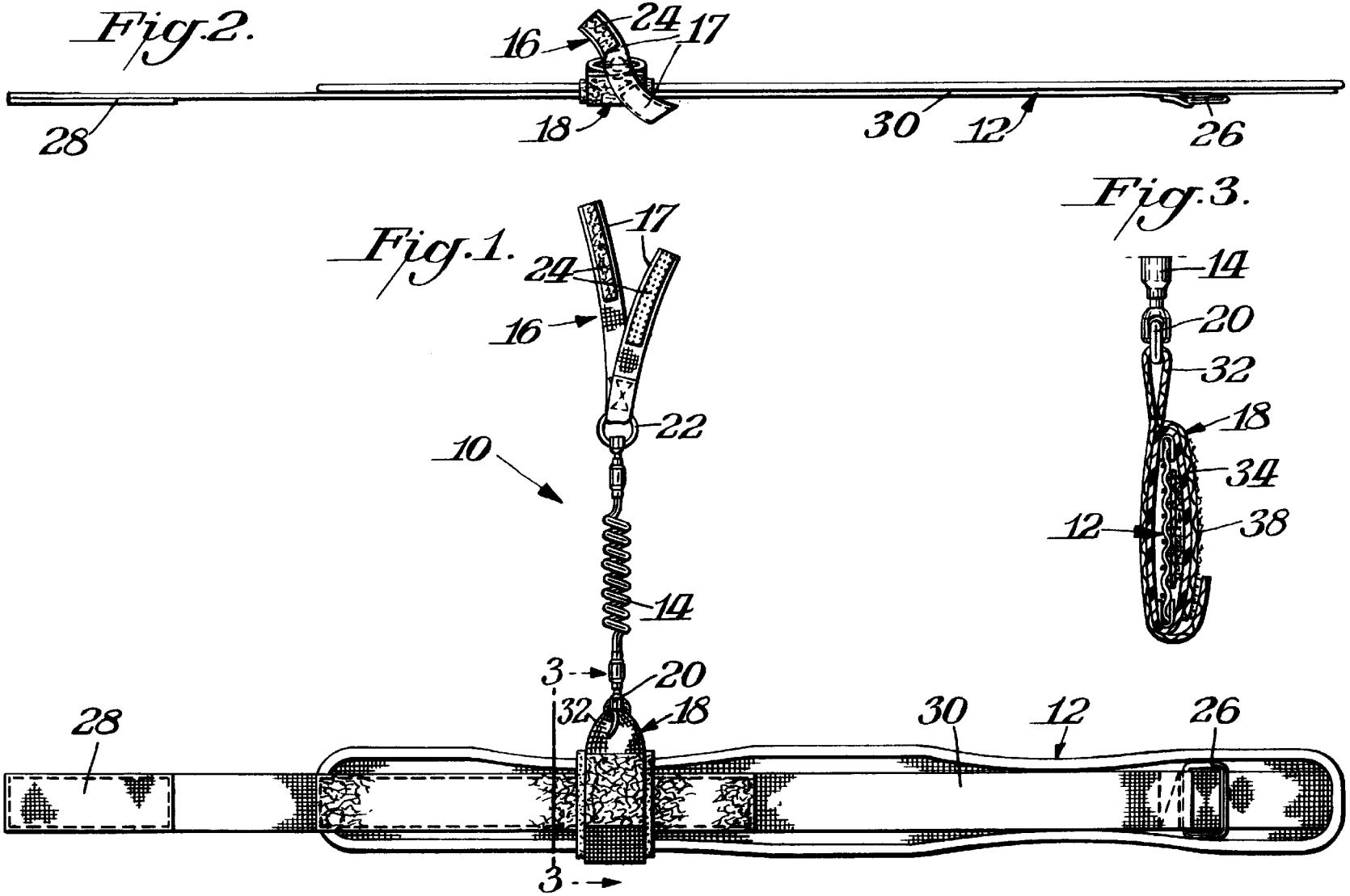
FIG. 1 is a side view of the basketball shooting aid according to the invention.
FIG. 2 is a top plan view of the basketball shooting aid of FIG. 1.
FIG. 3 is a cross-sectional view in elevation taken along line 3—3 of FIG. 1 showing the attachment of the elastic cord to the belt.
Figure 4:
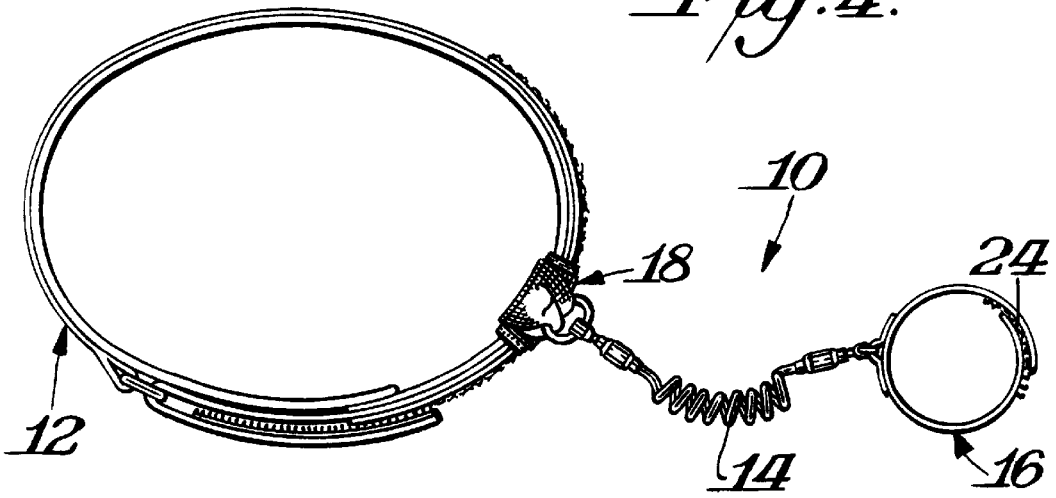
FIG. 4 is a top plan view of the assembled basketball shooting aid.

The sleeve can take any suitable form or be made of any suitable material so long as the sleeve is sufficiently close-fitting around the shooting arm so as to not slip off the elbow region during use. Furthermore, the sleeve must not be so tight so as to cause discomfort during use. The sleeve can be a one-piece assembly such as an elastic band. The sleeve can be a strap with two ends that are removably fastened around the elbow region of the player's shooting arm. In an embodiment where the sleeve is a strap, it can be held together by hook and loop connectors, by snaps, by clips, by a zipper, or any other suitable means. Hook and loop connectors are particularly preferred. In another preferred embodiment, the sleeve comprises a releasably fastened elastic band or loop. A preferred material for the sleeve is elastic fabric.

The elastic cord may be coiled or straight. The cord should be of sufficient length to provide resistance that keeps the player's elbow in towards the center line of the body during shooting. The resistance is generally lateral resistance so that the player's elbow is kept in towards the center line of his body during shooting. The length of the cord may vary depending on the height and width of the shooter. A preferred length for the cord is seven to eleven inches. Nine inches is particularly preferred. For a cord of fixed length, the shooter may vary the placement of the clip on the shooter's body to find the optimum placement.

The cord may be made of any suitable resilient or elastic material that provides sufficient tension to resist movement of the player's elbow in his shooting arm away from the centerline of the body during shooting. Polyurethane of 0.28 durometers is particularly preferred. It is important in selecting a material that the cord retain its elasticity after repeated uses by the shooter.

The sleeve is attached to the elastic cord by any conventional means. The sleeve can be glued to the cord, tied to the cord, integrally formed with the cord, or attached by any other suitable means. The attachment needs to be of sufficient strength to withstand repeated stresses that occur when the shooting aid is used.

The clip can be made of any suitable material. Plastic or very lightweight metal is preferred. Stainless steel is particularly preferred. The clip can be of various shapes and forms. The clip must also have sufficient holding strength to withstand repeated stress during shooting. The clip is attached to the player's clothing, preferably gym shorts or a shirt worn by the basketball player. The clip is most preferably attached to gym shorts.

The elastic cord may be attached to the clip by any conventional means. The cord may be glued to the clip, tied to the clip, integrally formed with the clip, or attached by any other suitable means. The attachment needs to be of sufficient strength to withstand repeated stresses that occur when the shooting aid is used.

In an alternate embodiment of the invention, the elastic cord is attached to a belt worn by the player. The belt may be made of any suitable material. For example, the belt can be made of nylon, cloth or leather. A weave of cloth and rubberized polyvinylchloride is preferred. The conventional methods for connecting the cord to the clip described above are equally applicable to connecting the cord to the belt. In a preferred method, the cord is adjustably attached to the belt. The adjustable attachment permits the shooter to find the optimum placement of the cord along the belt.

In operation, the sleeve is usually placed around the shooting arm near the elbow region. The clip is attached to the clothing at a point on the body sufficient for the cord to resist movement of the shooting elbow away from the centerline of the body during shooting. This point is preferably on the hip of the player opposite the shooting arm. That is, for a right-handed shooter, the clip would be preferably attached to clothing near the left hip area. However, other points may be suitable to provide sufficient resistance depending on the height and width of the player and the length of the cord. Routine experimentation may be conducted to provide the optimum point of attachment. Upon shooting the basketball, if the shooting elbow drifts away from the centerline of the body, the cord provides sufficient tension to pull the elbow back towards the centerline of the body.

In the embodiment where the elastic cord is adjustably attached to a belt, the cord should be placed at a point sufficient to provide passive resistance to keep the shooting elbow along the centerline of the body. This is usually at or near the player's hip opposite his shooting arm. Routine experimentation may be conducted to provide the optimum point of attachment.

The shooting aid (10) used to train basketball players according to the invention is shown in FIGS. 1–4. Referring first to FIG. 1, the device comprises a belt (12), an elastic or resilient cord (14) and a sleeve (16), which is shown here as two unconnected opposing straps (17). The cord (14) is adjustably attached to the belt by means of an attaching assembly (18). One end of the cord (14) is attached to the attaching assembly by connector (20). The other end of the cord is attached to the sleeve by connector (22). The sleeve encircles the elbow region of the player's shooting arm and is fastened together by pressing together the mating fastener strips (such as Velcro® hook and loop) (24). The belt has a buckle (26) and a tongue with hook fasteners attached to it (28). The belt has loop fasteners (30) at a point past the buckle (26). Tongue (28) is inserted through buckle (26) and the hook and loop fasteners are connected to hold the belt around the player's waist.

As shown in FIG. 3, the attaching assembly (18) has a connecting loop (32) that attaches to the cord (14) via connector (20). The connecting loop attaches to a strap (34). The strap (34) wraps around the belt (12) (not shown) in FIG. 3 and forms a loop by means of hook and loop connectors (36). The strap (34) has padding (38) in it to provide durability and comfort.

Figure 5:
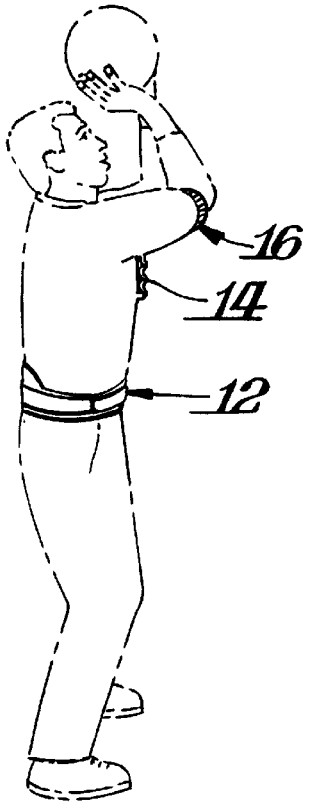
FIG. 5 is a side view of a player shooting a basketball while wearing the shooting aid with the shooting elbow in an incorrect shooting position.
Figure 6:
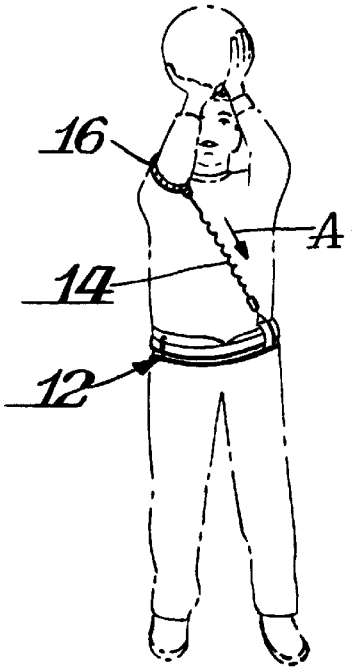
FIG. 6 is a front view of a player shooting a basketball while wearing the shooting aid with the shooting elbow in an incorrect shooting position.

FIGS. 5 and 6 show a basketball player shooting a basketball with his elbow in the incorrect shooting position. That is, the elbow is away from the centerline of the body. As shown in FIG. 6, the shooting aid provides tension in the direction of arrow (A) to the elbow to pull it back towards the centerline of the body.

FIG. 7 shows a basketball player shooting a basketball with his elbow in the correct shooting position. In this figure, the elbow is along the centerline of the body, which is represented by dot-dash vertical line (B).

An additional embodiment of the shooting aid (10) is shown in FIG. 8. In this embodiment, belt (39) has a buckle and tongue (40). When the strap of the belt is held by the buckle, the tongue (40) is inserted into holes (42) in the strap.

FIG. 9 shows a preferred embodiment of the invention in which the cord (14) is attached to the player's clothing (46) by a clip (44) and to a sleeve not shown at its opposite end.

We claim:

1. A method for shooting a basketball which comprises shooting the basketball while wearing a shooting aid which comprises:

a sleeve adapted to be fit around the shooting arm of the basketball player;

a clip adapted to be secured to clothing worn by the basketball player; and an elastic cord with two ends having one end attached to the sleeve and the other end attached to the clip, wherein the cord is of sufficient length to restrain the position of the player's shooting and when the player shoots a basketball.

2. The method as claimed in claim 1, wherein the sleeve is adapted to be worn proximate to the elbow of the player's shooting arm.

3. The method as claimed in claim 1, wherein the sleeve comprises a releasably fastened band.

4. The method as claimed in claim 1, wherein the clip is adapted to be attached to gym shorts worn by the basketball player.

5. The method as claimed in claim 1, wherein the clip is adapted to be attached to a shirt worn by the basketball player.

6. A method for shooting a basketball which comprises shooting the basketball while wearing a shooting aid which comprises:

a sleeve adapted to be fit around the arm of the basketball player;

a belt adapted to be worn by the basketball player; and an elastic cord with two ends having one end attached to the sleeve and the other end attached to the belt, wherein the cord is of sufficient length to restrain the position of the player's shooting arm when the player shoots a basketball.

7. The method as claimed in claim 6, wherein the belt is adapted to be worn around the basketball player's waist.

8. The method as claimed in claim 6, wherein the sleeve is adapted to be worn proximate to the elbow of the player's shooting arm.

9. The method as claimed in claim 6, wherein the sleeve comprises a releasably fastened band.

* * * * *